United States Patent [19]

Simons

[11] 4,088,176

[45] May 9, 1978

[54] METHOD OF MAKING FERROTITANIUM ALLOY

[75] Inventor: Harold Martell Simons, Orem, Utah

[73] Assignee: Billings Energy Corporation, Provo, Utah

[21] Appl. No.: 691,235

[22] Filed: Jun. 1, 1976

[51] Int. Cl.[2] ..... B22D 21/02

[52] U.S. Cl. ..... 164/66; 75/123 M; 164/80; 164/91

[58] Field of Search ..... 75/123 M, 129, 175.5, 75/44 S; 164/66, 80, 91

[56] References Cited

U.S. PATENT DOCUMENTS

| | | | |
|---|---|---|---|
| 1,978,222 | 10/1934 | Otte | 164/66 X |
| 3,063,831 | 11/1962 | Grady | 75/129 |
| 3,672,879 | 6/1972 | Buehler | 75/175.5 X |
| 3,854,195 | 12/1974 | Landig | 164/138 X |
| 3,982,926 | 9/1976 | Geck et al. | 75/44 S X |

*Primary Examiner*—Richard B. Lazarus
*Attorney, Agent, or Firm*—Terry M. Crellin

[57] ABSTRACT

A method of producing ferrotitanium alloy from sponge titanium includes placing sponge titanium in a receptacle and pouring molten iron or steel onto the titanium so that the molten metal flows downwardly and outwardly through the titanium to melt the titanium and mix therewith. While the molten iron or steel is being poured onto the titanium, an inert gas in introduced into the receptacle to prevent oxidation of the titanium. After the molten iron or steel has melted the titanium, the mixture is stirred to eliminate porosity in the resulting alloy.

9 Claims, 1 Drawing Figure

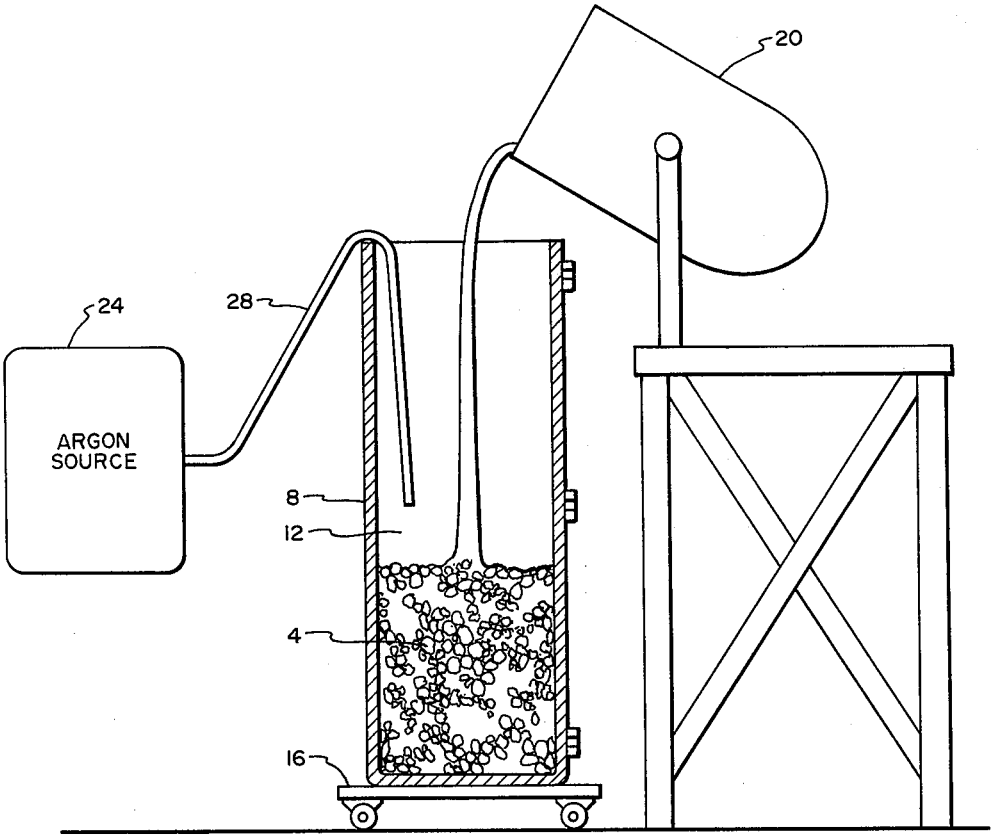
20
24
28
ARGON
SOURCE
8
12
4
16

METHOD OF MAKING FERROTITANIUM ALLOY

BACKGROUND OF THE INVENTION

This invention relates to a method of producing ferrotitanium alloy from sponge titanium.

The problems of making titanium alloys are well known. These problems arise from the strong tendency of titanium to oxidize and to react with most crucible materials.

A number of techniques have been developed for producing titanium alloy and, in particular, iron titanium alloy, with these techniques experiencing varying degrees of success at varying degrees of cost and complexity. One of the more common techniques is the so-called consumable electrode arc melting method in which powdered iron or steel and titanium are compressed into an electrode and then melted in an electric arc furnace. Although a fairly contaminant free (oxygen free) iron titanium alloy can be obtained using this technique, the production costs are high because of the high cost of electric arc furnaces and the need for first making an electrode of compressed iron or steel and titanium.

A number of other methods have also been suggested for making titanium alloys including those disclosed in U.S. Pat. Nos. 3,410,679 and 3,063,831. In the latter mentioned patent, a process is disclosed in which a charge of titanium scrap (turnings and plate stampings) is placed in a mold or ladle and molten metal is poured onto the scrap. With this method, it is claimed that ferrotitanium containing about 10 to 30% titanium can be obtained. One problem with this process, and possibly the reason for the relative low percentage of titanium which can be obtained in the alloy, is that charges of scrap titanium are quite vacuous, i.e., filled with voids, and so when molten metal is poured onto a charge, the metal has a tendency to flow quickly through the charge to the bottom of the container. As a result, only a portion of the charge is melted, this being that portion directly in the flow path of the molten metal. To insure more complete melting of the charge, the amount of the charge may simply be reduced so that when the molten metal is poured thereover, it covers the entire charge. But, of course, since the amount of titanium must be reduced to achieve this, the resulting alloy contains low percentages of titanium.

SUMMARY OF THE INVENTION

It is an object of the present invention to provide a new and inexpensive method of producing ferrotitanium alloy.

It is another object of the present invention to provide a method of producing ferrotitanium alloy from sponge titanium.

It is a further object of the present invention to provide a method of producing ferrotitanium alloy having up to 65% titanium by weight.

These and other objects of the invention are realized in an illustrative method of producing ferrotitanium alloy from sponge titanium in which sponge titanium is placed in a receptacle which holds the titanium in a generally vertical column, and molten iron or steel is poured into the receptacle onto the top of the column of titanium so that the iron or steel flows downwardly and outwardly to melt the titanium and mix therewith. Because of the density of sponge titanium, the molten iron or steel is partially impeded in its downward flow causing the iron or steel to move outwardly as well as downwardly to thereby more effectively melt the titanium charge in the receptacle.

BRIEF DESCRIPTION OF THE DRAWING

The above and other objects, features and advantages of the present invention will become apparent from a consideration of the following detailed description presented in connection with the accompanying drawing which shows, diagrammatically, apparatus for carrying out the method of the invention.

DETAILED DESCRIPTION

In the method of the present invention, sponge titanium 4 is placed in a suitable receptacle such as a ladle or mold. Preferably, the titanium is placed in a hinged mold 8 having a generally elongate interior cavity 12. Placement of the titanium 4 in such a mold serves to form the titanium in generally a vertical column. This facilitates the more complete melting of the titanium. For convenience, the mold 8 is placed upon a dolly 16 or other suitable apparatus for carrying and moving the mold.

Iron or steel is melted in any conventional apparatus such as an induction furnace and heated to a temperature of about 2400° to 2600° F. The molten iron or steel is then poured from a ladle or crucible 20 onto the top of the titanium 4 held in the mold 8. During the pouring operation, argon gas or other inert gas is injected into the mold to displace oxygen and thereby inhibit oxidation of the titanium. The argon gas may be injected from an argon source 24 through tubing 28 downwardly into the cavity 12 of the mold.

It has also been found advantageous to "flush" the sponge titanium with inert gas just prior to pouring the molten iron or steel onto the titanium. This is done simply by forcing the tubing 28 into the charge of sponge titanium 4 and then injecting gas through the tubing into the interstices of the titanium. The tubing 28 is then removed from the titanium 4 and the molten iron or steel is poured over the titanium while inert gas is injected into the mold cavity above the titanium.

After the molten iron or steel has been poured into the mold 8 to melt the sponge titanium 4, the molten alloy is stirred for about five minutes, by use of an argon stick or other suitable device, to eliminate porosity in the resulting alloy.

After stirring, the iron titanium melt is allowed to cool and harden to allow removal of the hardened ingot from the hinged mold 8.

Because sponge titanium is relatively inexpensive and readily available, the method of the present invention is very economical. The sponge titanium is in the form of porous particles ranging in size from a few microns to about an inch in thickness, with the bulk of the particles being between about 1/16 and 3/8 of an inch in thickness. The bulk density of sponge titanium ranges from about 0.9 to 1.3 grams per cubic centimeter. With this form of titanium, the molten iron or steel, when poured onto the top of the titanium charge, does not simply melt a narrow column of the titanium as it would with scrap titanium (turnings and stampings) because the sponge titanium partially impedes the flow of the molten iron or steel causing it to spread outwardly as it moves downwardly. In this manner, the molten iron or steel "reaches" outwardly to melt the sponge titanium near the side walls of the mold. This is the reason that the sponge titanium is preferably placed in a mold having a generally elongate vertical cavity so that the molten iron and steel is provided with a fairly long downward path to travel through the titanium thus presenting greater opportunity for contact of the titanium by the molten iron or steel.

With the above-described method, ferrotitanium alloy having up to 65% titanium, by weight, can be produced and such alloy is relatively contaminant free.

The following examples provide illustrations of the process of the present invention.

EXAMPLE 1

Seventeen pounds of sponge titanium was placed in a cylindrical chamber of a mold, the chamber being 31 inches in height and 8 inches in diameter. The mold comprised two halves, hinged along one elongate side. Twenty pounds of scrap steel was melted in an induction furnace, and when the molten steel reached a temperature of about 2400° F, it was poured onto the top of the titanium to completely melt it. While pouring the steel, argon gas was directed into the mold chamber above the titanium. After completion of pouring the steel, the melt was stirred with an argon stick for about 5 minutes and then allowed to cool and solidify. The composition of the resulting alloy was 54% steel by weight and 46% titanium. Because of oxidation of some of the sponge titanium and further refining (to produce slag) of some of the steel, the total weight of the resulting alloy was about 75% of the combined weight of the starting materials. The percentage of steel to titanium in the resulting alloy, however, was the same as in the starting materials.

EXAMPLE 2

Using the same mold as in Example 1, twenty pounds of scrap steel and 14 ounces of manganese were melted in an induction furnace to a temperature of about 2400° F and then poured over twenty-two pounds of sponge titanium placed in the mold chamber. Argon gas was again injected during pouring and the melt was stirred. The resulting alloy was 46% steel by weight, 2% maganese, and 52% titanium.

EXAMPLE 3

Again, using the same mold as in Example 1, twenty pounds of scrap steel was melted in an induction furnace to about 2600° F and then poured over 37 pounds of sponge titanium placed in the mold chamber as argon gas was injected into the chamber. The titanium was all melted and the melt stirred to obtain an alloy having 35% steel by weight and 65% titanium.

It is to be understood that the above-described arrangement is only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A method of making ferrotitanium alloy containing, by weight, from in excess of 30 percent titanium to about 65 percent titanium comprising the steps of providing a container holding at least a preselected weight of molten iron or steel, placing sponge titanium particles in a receptacle, said titanium having a bulk density of from about 0.9 grams per cubic centimeter to about 1.3 grams, the weight of said titanium being between about 30 percent and 65 percent of said preselected weight of said iron or steel, and pouring said preselected weight of molten iron or steel onto the sponge titanium particles so that the molten iron or steel flows outwardly and downwardly throughout the titanium to thereby melt the titanium and mix therewith to form a ferrotitanium alloy having substantially the same percentage of iron or steel to titanium as in the starting materials.

2. A method as in claim 1 further comprising the step of introducing an inert gas into the receptacle during the pouring step.

3. A method as in claim 2 further comprising the step of intorducing an inert gas into the interstices of the sponge titanium just prior to the pouring step.

4. A method as in claim 2 further comprising the step of stirring the molten bath of iron or steel and titanium after the titanium is melted.

5. A method as in claim 2 wherein the receptacle comprises a mold having a vertically disposed elongate interior cavity.

6. A method of producing ferrotitanium alloy containing, by weight, from an excess of 30 percent titanium to about 65 percent titanium comprising providing a container holding at least a preselected weight of molten metal selected from the group consisting of iron and steel, placing titanium having a bulk density of from about 0.9 grams per cubic centimeter to about 1.3 grams in a receptacle which holds the titanium in a generally vertical column, the weight of said titanium being between about 30 percent and 65 percent of said preselected weight of said metal, and pouring said preselected weight of molten metal into the receptacle onto the top of the column of titanium so that the molten metal flows downwardly and outwardly to melt the titanium by the heat from the molten metal to mix therewith and form a ferrotitanium alloy having substantially the same percentage of metal to titanium as in the starting materials.

7. A method as in claim 6 further comprising flushing the interstices of the titanium with inert gas just prior to the pouring step and introducing an inert gas into the receptacle during the pouring step.

8. A method as in claim 7 further comprising stirring the melt following the pouring step.

9. A method as in claim 8 wherein the receptacle comprises a hinged mold, said method further comprising cooling the ferrotitanium alloy in the mold until it solidifies, and removing the alloy from the mold.

* * * * *